US005682176A

United States Patent [19]

Matino et al.

[11] Patent Number: 5,682,176

[45] Date of Patent: Oct. 28, 1997

[54] APPARATUS AND METHOD FOR DRIVING LIQUID CRYSTAL

[75] Inventors: Haruhiro Matino, Kanagawa-ken; Akihiro Funakoshi, Kamakura; Isamu Miwa, Fujisawa, all of Japan

[73] Assignee: International Business Machines Corporation, Armonk, N.Y.

[21] Appl. No.: 757,650

[22] Filed: Nov. 25, 1996

Related U.S. Application Data

[63] Continuation of Ser. No. 365,623, Dec. 28, 1994, abandoned.

[30] Foreign Application Priority Data

Dec. 28, 1993 [JP] Japan ..... 5-337282

[51] Int. Cl.[6] ..... G09G 3/36

[52] U.S. Cl. ..... 345/98; 345/99

[58] Field of Search ..... 345/98, 99, 100, 345/87, 88, 89, 90, 94, 96, 211, 212, 213, 208, 209, 210; 348/790, 791, 792, 793; 349/33, 36; H04N 3/14, 9/30

[56] References Cited

U.S. PATENT DOCUMENTS 4,694,349 9/1987 Takeda et al. ..... 348/793

5,166,670 11/1992 Takeda et al. ..... 345/98

5,252,957 10/1993 Itakura ..... 345/98

*Primary Examiner*—Xiao Wu

*Attorney, Agent, or Firm*—Ronald L. Drumheller

[57] ABSTRACT

In order to drive a liquid crystal panel without causing flickering or noise on a screen, an analog signal (R) is input to sample and hold circuits SH through an amplifier 14. When the first half of the clock signals is input, the voltage values of the analog signal which are held in the corresponding circuits SH1 . . . SH(n/2) are added up in an adder 16, divided by n/2 in a divider 18, and output to a circuit SH(n/2+1). When the second half of the clock signals is input, the voltage values which are held in the corresponding circuits SH(n/2+2) . . . SH(n+1) are added up in an adder 16', divided (by n/2) in a divider 18', and output to a circuit SH(n+2). The outputs from the circuits SH(n/2+1) and SH(n+2) are summed in an adder 24 and divided by 2 in a divider 26. A driver circuit applies a voltage to the corresponding electrode of a liquid crystal panel according to the output from the divider 26.

5 Claims, 5 Drawing Sheets

1
2
n/2
n/2+1
n/2+2
n/2+3
n+1
n+2
12
10
100
SH1
SH2
SH(n/2)
SH(n/2+1)
SH(n/2+2)
SH(n/2+3)
SH(n+1)
SH(n+2)
16
18
16'
18'
R
14
24
26

APPARATUS AND METHOD FOR DRIVING LIQUID CRYSTAL

This is a continuation of application Ser. No. 08/365,623, filed Dec. 28, 1994, now abandoned.

BACKGROUND ART

1. Field of the Invention

The present invention is related to an apparatus and method for driving liquid crystal, and, more specifically, to an apparatus and a method for driving liquid crystal in which a liquid crystal panel is driven based on an analog signal representing an image by a voltage.

2. Related Art

To display an image using a cathode ray tube (CRT), a digital signal corresponding to an image processed in a computer and the like is converted to an analog signal in an analog signal interface and input to the input terminal of the CRT. The input analog signal is a time series signal (voltage waveform) for each pixel on the CRT. Based on the analog signal, three electron beams excite the corresponding red, blue, and green fluorescent materials applied to the faceplate of the CRT, thereby to emit light. As a result, the red, blue, and green fluorescent materials in a pixel on the CRT screen emit light. The distribution of the electron beams ($A/m^2$) per unit area (one pixel) is a Gaussian distribution, and the emission is recognized by the human eye as the emission of an envelope based on an analog signal from which high frequency components have been removed.

If it is desired to display an image at a place other than the location at which the CRT is installed, the image may be displayed on a liquid crystal display (LCD), which is convenient to carry. In this case, an analog signal (voltage waveform) converted to analog in the analog signal interface of a computer is input to the LCD. Thus, as a method for driving an LCD based on an analog signal representing an image by a voltage waveform, it is possible to conceive of the detection of representative values (voltage values) from an analog signal corresponding to each pixel, and applying a voltage on the basis of the detected voltage values to the corresponding electrode of a liquid crystal panel.

However, this method has the following problem: That is, one screen of a liquid crystal display device is formed by applying the representative values detected at predetermined times to the corresponding electrodes of a liquid crystal panel to scan the entire screen and repeating this process a plurality of times. Since the voltage waveform representing an image is not fixed in value, as shown in FIG. 5, if the timing for detecting the representative values deviates as is shown by t1 and t2, the detected representative values are different, as is shown by V1 and V2. As a consequence, since the representative values detected for one pixel are different from those detected in another cycle, flickering or noise occurs on the screen.

SUMMARY OF THE INVENTION

The present invention was accomplished in view of the above-mentioned fact, and its object is to provide an apparatus and a method for driving liquid crystal which drives a liquid crystal panel without causing such flickering or noise on the screen.

To accomplish the above object, the invention comprises an input means for inputting an analog signal representing an image by a voltage waveform, an integration means for integrating and outputting the discrete voltages of the input analog signal for each pixel, and an application means for applying a voltage, on the basis of the output of the integration means, to the corresponding electrode of a liquid crystal panel.

The integration means preferably consists of a clock signal output means for outputting a plurality of clock signals at a predetermined time interval for the analog signal for each pixel, a plurality of sample and hold circuits for holding the voltage values of the voltage waveform of the analog signal input by the input means, an adder for adding the voltages held in the respective sample and hold circuits, and a divider for dividing the added voltages by the number of clock signals.

The invention also is a method that comprises the steps of inputting an analog signal representing an image by a voltage waveform, integrating and outputting the discrete voltages of the input analog signal for each pixel, and applying a voltage on the basis of the output to the corresponding electrode of a liquid crystal panel.

In this method, the step of integrating the discrete voltages for each pixel is performed by outputting a plurality of clock signals at a predetermined time interval for the analog signal for each pixel, holding the voltage values of the analog signal each time the plurality of clock signals is input, adding the plurality of voltage values held, and dividing the added voltage values by the number of clock signals.

In the invention, an analog signal representing an image by a voltage waveform is input, the discrete voltages of the input analog signal for each pixel are integrated and output, and a voltage is applied on the basis of the output to the corresponding electrode of a liquid crystal panel.

The integration of the discrete voltages for each pixel is performed by outputting a plurality of clock signals at a predetermined time interval for the analog signal for each pixel, holding the voltage values of the analog signal each time the plurality of clock signals is input, adding the plurality of voltage values held, and dividing the added voltage values by the number of clock signals.

Thus, since the discrete voltages for each pixel of an analog signal representing an image by a voltage waveform are integrated and output, and a voltage is applied on the basis of the output to the corresponding electrode of a liquid crystal panel, in one screen formed by a plurality of scans, the same voltage is always applied to the corresponding electrode for each pixel of the liquid crystal panel. This enables the liquid crystal panel to be driven without causing flickering or noise on the screen.

DESCRIPTION OF THE PREFERRED EMBODIMENTS

Figure 1:
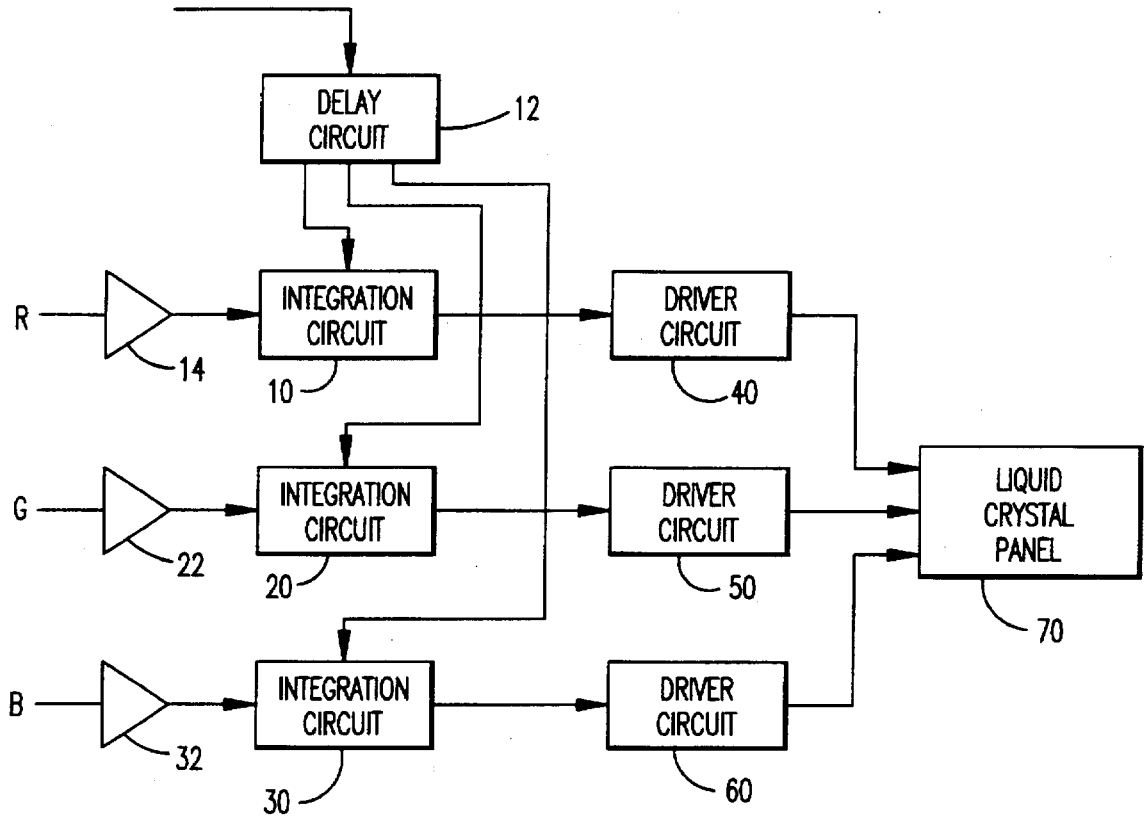
FIG. 1 is a block diagram of a first embodiment.

A first embodiment of the present invention will now be described in detail with reference to the accompanying drawings. The block diagram of the apparatus for driving liquid crystal of this embodiment is shown in FIG. 1. As shown in FIG. 1, the apparatus for driving liquid crystal includes amplifiers 14, 22, and 32 for amplifying the analog signals (R, G, B) output by an analog signal interface as an input means (not shown). The amplifiers 14, 22, and 32 are connected to integration circuits 10, 20, and 30. A delay circuit 12 is connected to the integration circuits 10, 20, and 30. Further, driver circuits 40, 50, and 60 are connected to the integration circuits 10, 20, and 30 as an application means for applying a voltage to the corresponding electrodes of a liquid crystal panel 70 on the basis of the integrated values calculated in the integration circuits 10, 20, and 30. Although any of TFT, MIM, STN, and the like can be used in a liquid crystal, a TFT LCD is used in this embodiment. The delay circuit 12 shifts a predetermined pulse input to the delay circuit 12 by a predetermined time interval for each pixel of the analog signal, thereby to output n+2 clock signals CS1, CS2, CS3, ... CS(n+2) to the integration circuits 10, 20, and 30.

Figure 2:
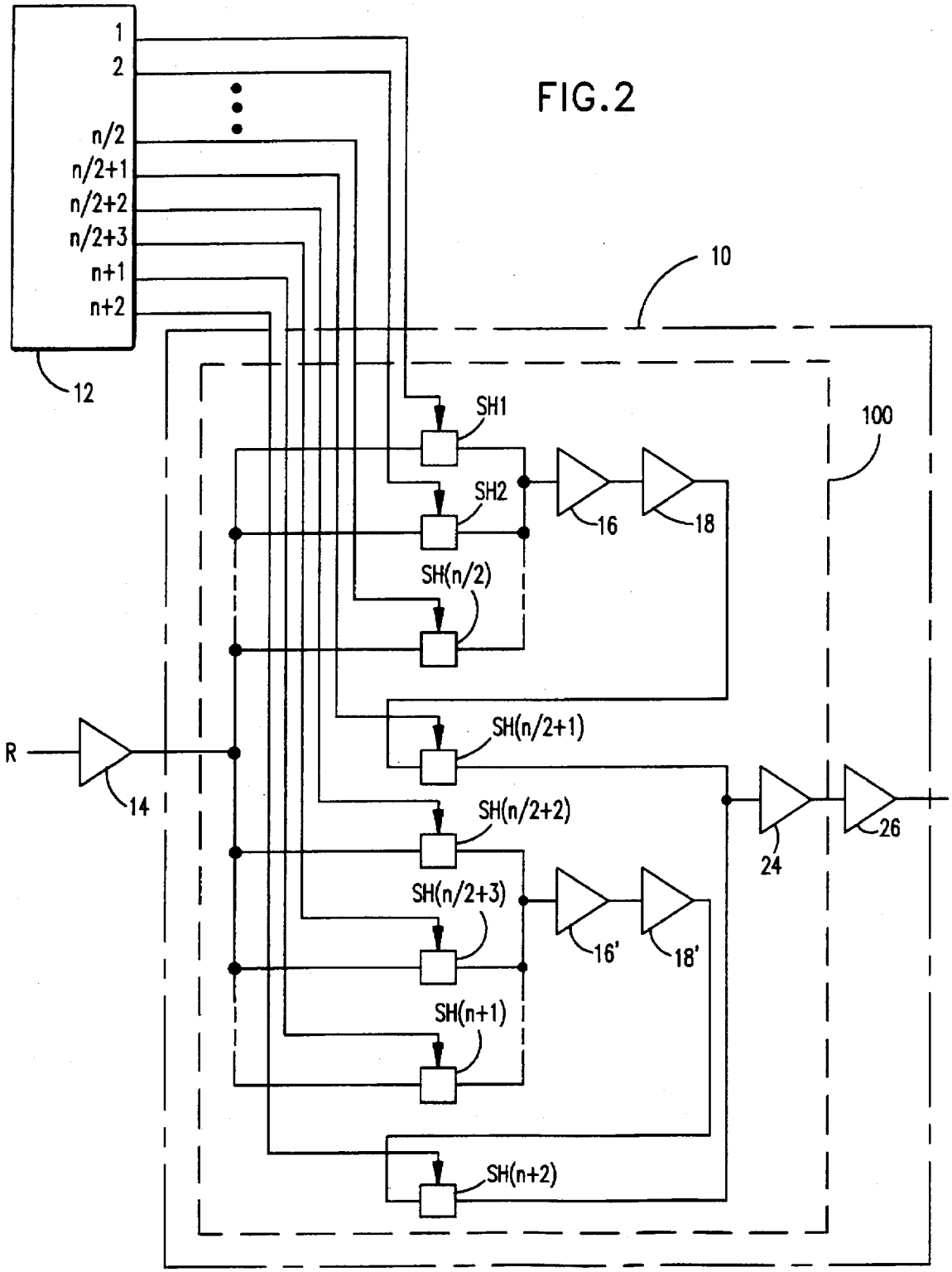
FIG. 2 is a diagram showing the details of the integration circuit of the first embodiment.

The integration circuits 10, 20, and 30 are described below with reference to FIG. 2. Since the integration circuits 10, 20, and 30 have a similar structure, only the integration circuit 10 corresponding to the analog signal (R) is described. As shown in FIG. 2, the amplifier 14 for amplifying the analog signal is connected to the sample and hold circuits SH1, SH2, . . . SH(n/2), SH(n/2+2), SH(n/2+3), . . . SH(n+1) of the integration circuit 10. Each of the sample and hold circuits SH1, SH2, . . . SH(n/2) is connected to an adder 16, which is connected to a divider 18. The divider 18 is connected to a sample and hold circuit SH(n/2+1). Each of the sample and hold circuits SH(n/2+2), SH(n/2+3), . . . SH(n+1) is connected to an adder 16', which is connected to a divider 18'. The divider 18' is connected to a sample and hold circuit SH(n+2). The sample and hold circuits SH(n/2+1) and SH(n+2) are connected to an adder 24, which is connected to a divider 26.

The operation of the apparatus for driving liquid crystal of this embodiment will now be described with reference to FIGS. 2 and 3. Incidentally, also in this case as in done above, only the operation of the processing of the analog signal (R) is described.

Figure 3:
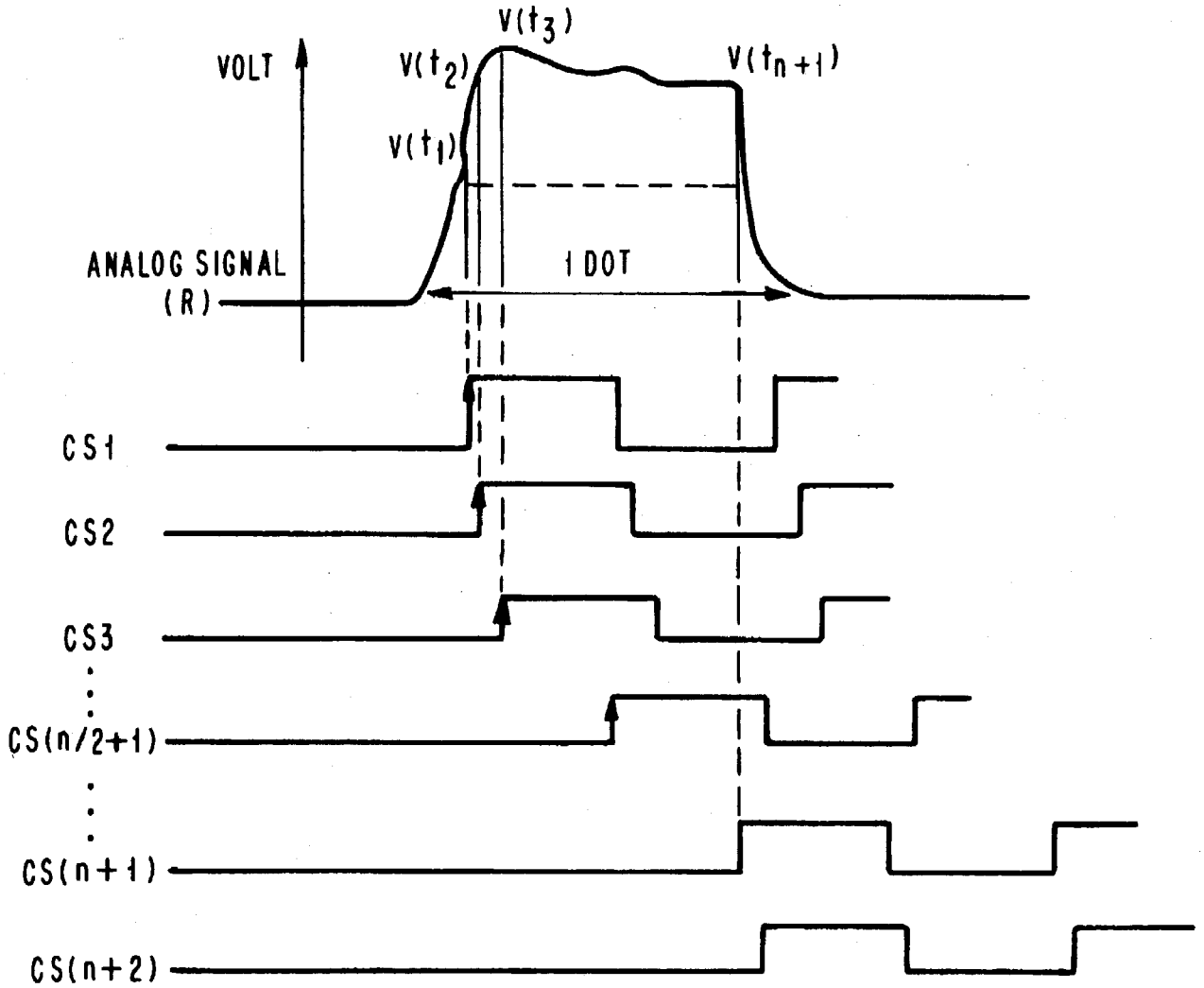
FIG. 3 is a diagram showing the relationship between the voltage waveform in a pixel and the voltage values of the voltage waveform which are held by the output clock signals.

The analog signal (R) output by an analog signal interface (not shown) is amplified in the amplifier 14, as shown in FIG. 3, so as to be stripped of high frequency components to the extent that the original shape is maintained, and input to the sample and hold circuits SH1 . . . SH(n+1) other than SH(n/2+1) and SH(n+2). In addition, the delay circuit 12 outputs n+2 clock signals CS1 . . . CS(n+2) for each pixel at predetermined times to the sample and hold circuits SH1 . . . SH(n+2).

The clock signals CS1 . . . CS(n+2) are input to the corresponding sample and hold circuits SH1 . . . SH(n/2). The sample and hold circuits SH1 . . . SH(n/2) hold the voltage values V(t1) . . . V(tn/2) of the analog signal (R) when the input clock signals CS1 . . . CS(n/2) rise (see FIG. 3). The sample and hold circuits SH1 . . . SH(n/2) output the voltage values V(t1) . . . V(tn/2) which they hold to the adder 16. The adder 16 adds up and outputs the voltage values V(t1) . . . V(tn/2) to the divider 18. The divider 18 divides the added voltage values by n/2, the number of clock signals output to the sample and hold circuits SH1 . . . SH(n/2), and outputs the result to the sample and hold circuit SH(n/2+1). The sample and hold circuit SH(n/2+1) holds the voltage value obtained by dividing the added voltage values V(t1) . . . V(tn/2) by n/2, the output from the divider 18, when the input clock signal CS(n/2+1) rises, and outputs the voltage value which it holds to the adder 24.

In addition, the clock signals CS(n/2+2) . . . CS(n+1) are input to the corresponding sample and hold circuits SH(n/2+2) . . . SH(n+1). The sample and hold circuits SH(n/2+2) . . . SH(n+1) hold the voltage values V(tn/2+2) . . . V(n+1) of the analog signal (R) when the input clock signals CS(n/2+2) . . . CS(n+1) rise. The sample and hold circuits SH(n/2+2) . . . SH(n+1) output the voltage values V(tn/2+2) . . . V(n+1) which they hold to the adder 16', respectively. The adder 16' adds up and outputs the voltage values V(tn/2+2) . . . V(n+1) to the divider 18'. The divider 18' divides the added voltage values by n/2, the number of clock signals output to the sample and hold circuits SH(n/2+2) . . . SH(n+1), and outputs the result to the sample and hold circuit SH(n+2). The sample and hold circuit SH(n+2) holds the voltage value obtained by dividing the added voltage values V(tn/2+2) . . . V(n+1) by n/2, the output from the divider 18', when the input clock signal CS(n+2) rises, and outputs the voltage value which it holds to the adder 24.

The adder 24 adds up and outputs the voltage values from the sample and hold circuits SH(n/2+1) and SH(n+2) to the divider 26. The divider 26 divides the sum by two. In this way, a value K obtained by the following equation (1) is output by the divider 26:

$$K=\frac{T}{n}\{V(t1)+V(t2)+\ldots+V(tn/2)+V(tn/2+2)+V(tn/2+3)+\ldots+V(tn+1)\} \quad (1)$$

In the above equation (1), T is the time unit for one pixel of the analog signal.

In addition, the above equation (1) is equivalent to the following equation (2):

$$K=\int_{t0}^{t0+T} V(t)dt \quad (2)$$

In the above equation (2), t0 is the time at which the discrete voltages of the analog signal for a pixel begin.

Accordingly, the above integration circuit integrates the discrete voltages for each pixel of the analog signal representing an image by a voltage waveform.

The value K from the divider 26 is then output to the driver circuit 40. The driver circuit 40 applies a voltage on the basis of the value K to the corresponding electrode of the liquid crystal panel 70.

In the first embodiment described above, since the discrete voltages for each pixel of an analog signal representing an image by a voltage waveform are integrated and output, and a voltage on the basis of the output is applied to the corresponding electrode of a liquid crystal panel, in one screen formed by a plurality of scans, the same voltage is always applied to the electrode of each pixel of the liquid crystal panel. This enables the liquid crystal panel to be driven without producing flickering or noise on the screen.

In addition, in the first embodiment described above, to enable the holding of the analog signal for the whole of one pixel in the viewpoint of timing, a sample and hold circuit is provided for holding the voltage value obtained by adding and dividing the discrete voltages of the first half of the analog signal, and a sample and hold circuit is provided for holding the voltage value obtained by adding and dividing the discrete voltages of the second half of the analog signal, and when the outputs from these sample and hold circuits are added and divided, that is, when the discrete voltages of the second half of the analog signal in a pixel are added and divided, the first half of the analog signal in the next pixel is added and divided.

A second embodiment of the present invention will now be described with reference to the drawings. Since this embodiment has a construction substantially similar to the above described first embodiment, the same portions are assigned the same symbols and the description thereof is omitted.

On the one hand, as seen from the above equation (1), if the number of voltage values of the discrete voltages to be held is increased, a more preferred integrated value (a value obtained from the equation (2)) of the voltage waveform corresponding to a pixel is accordingly obtained. On the other hand, sample and hold circuits require a sample and hold time from the outputting of a clock signal to the detection of the voltage values of a voltage waveform, the holding of the voltage values, and the outputting of the voltage values held.

Consequently, if the number of the clock signals per pixel is increased to increase the number of voltage values to be held, the sample and hold time needs to be shortened accordingly. However, a limit is imposed on the minimum sample and hold time by the performance of the sample and hold circuits, and they sometimes cannot deal with the increased number of clock signals.

In this embodiment, the increased number of clock signals is dealt with by the following construction: Although the following description is made only for the analog signal (R), similar constructions are used for the other analog signals (G, B). That is, integration circuits 90 and 100 similarly constructed to an integration circuit 80 for the analog signal (R) to be described later are provided for the analog signals (G. B).

Figure 4:
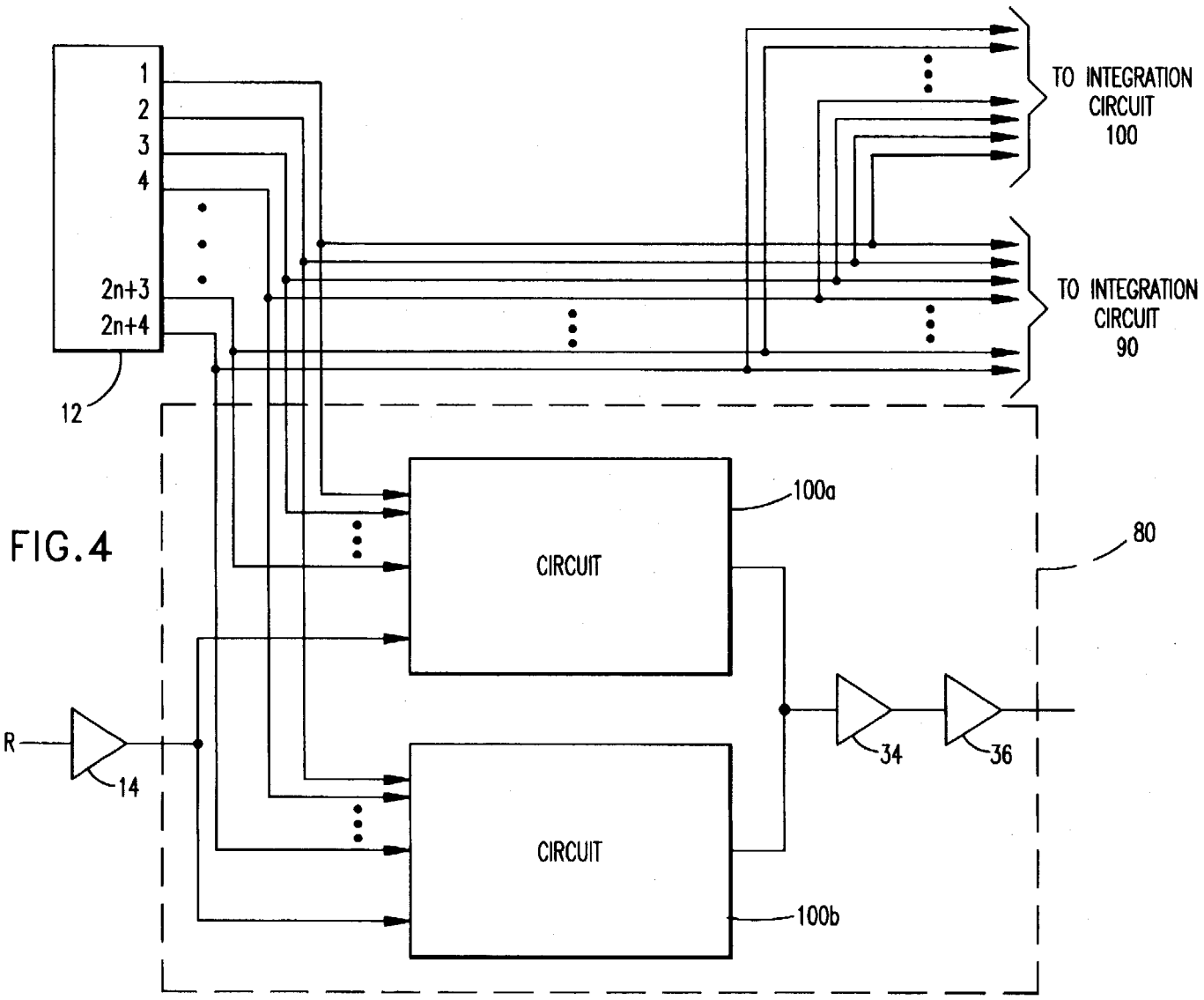
FIG. 4 is a diagram schematically showing the integration circuit of a second embodiment.
Figure 5:
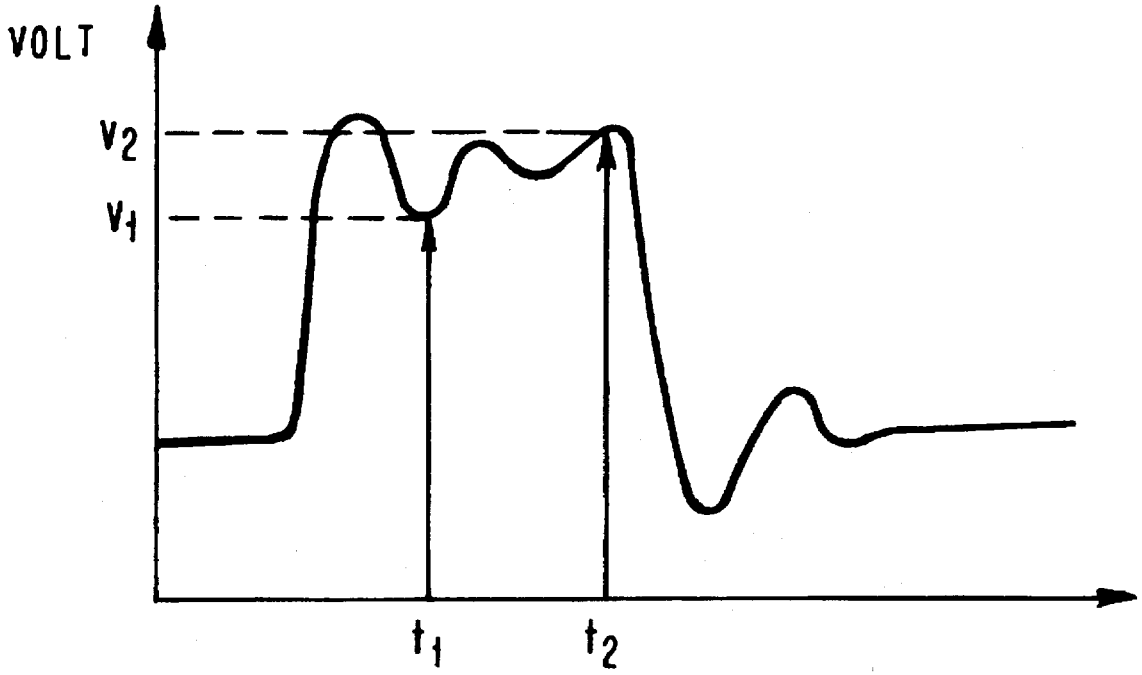
FIG. 5 is a diagram showing the voltage values of the voltage waveform in a pixel which are detected when the timing in the LCD is shifted.

In this embodiment, the number of voltage values of the discrete voltages is doubled from n to 2n. Further, the integration circuit 80 includes two circuits 100*a* and 100*b* similar to a circuit 100 (see FIG. 2) each obtained by removing the divider 26 from the integration circuit 10 of the first embodiment. Thus, as shown in FIG. 4, the number of clock signals output from the delay circuit 12 is 2n+4. The circuits 100*a* and 100*b* are each connected to an adder 34, which is connected to a divider 36.

The operation of this embodiment of such a construction is described below. The analog signal (R) amplified in the amplifier 14 is input to the sample and hold circuits (not shown) of the circuits 100*a* and 100*b*. The odd clock signals CS1, CS3, . . . CS(2n+3) are output to the circuit 100*a* by the delay circuit 12, and the even clock signals CS2, CS4, . . . CS(2n+4) are output to the circuit 100*b* by the delay circuit 12.

In response to the odd clock signals CS1, CS3, . . . CS(2n+1) input by the delay circuit 12, the sample and hold circuits of the circuit 100*a* hold the n voltage values V(tL), V(t3), . . . V(t2n+1) of the analog signal, as in the above described first embodiment. The adder (not shown) of the circuit 100*a* adds up the voltage values V(t1), V(t3), . . . V(t2n+1) which are held, and outputs the resultant voltage value to the adder 34.

Also, in response to the even clock signals CS2, CS4, . . . CS(2n+2) input from the delay circuit 12, the circuit 100*b* adds up the n voltage values V(t2), V(t4), . . . V(t2n+2) of the discrete voltages of the analog signal which are held, and outputs the resultant voltage value to the adder 34, as does the circuit 100*a*.

The adder 34 adds up the respective voltage values input from the circuits 100*a* and 100*b*, and outputs the sum to the divider 36, which divides the sum by 2n, the number of the clock signals output to the sample and hold circuits holding the voltage values of the analog signal, and outputs the result to the driver circuit 40. The driver 40 then applies a voltage on the basis of the output by the divider 36 to a corresponding electrode of a liquid crystal panel.

Thus, the two circuits, each obtained by removing the divider from the integration circuit of the first embodiment, hold the voltage values of the discrete voltages on the basis of the odd and even clock signals, respectively. The voltages held are then added up and the added voltages are integrated by being divided by the number of clock signals. For this, the number of clock signals can be increased even in sample and hold circuits in which the minimum sample and hold time is restricted from the performance aspect, whereby there can be obtained the preferred integrated value of the discrete voltages.

In the second embodiment described above, two circuits are provided which are each obtained by removing the divider from the integration circuit of the first embodiment, and, in response to the provided circuits, clock signals are divided into odd ones and even ones, but this is not restrictive, for instance, three, four, . . . circuits may be provided which are each obtained by removing the divider from the integration circuit of the first embodiment, and clock signals may be sequentially output in response to the provided circuits.

As described above, in the present invention, since the discrete voltages for each pixel of an analog signal representing an image by a voltage waveform are integrated and output, and based on the output, a voltage is applied to the corresponding electrode of a liquid crystal panel, in one screen formed by a plurality of scans, the same voltage is always applied to the electrode for each pixel of the liquid crystal panel, which leads to the effect that the liquid crystal panel can be driven without producing flickering or noise on the screen.

We claim:

1. An apparatus for driving liquid crystal which comprises:

an input means for inputting an analog signal representing an image as a voltage waveform, each pixel of said image corresponding uniquely to a predetermined single time interval of said analog signal, means for sampling said analog signal a multiplicity of different times during said predetermined single time interval corresponding to any particular pixel to produce a multiplicity of voltage values corresponding to said any particular pixel, an integration means for integrating the multiplicity of voltage values sampled for said any particular pixel to produce an integrated value for said any particular pixel, and an application means for applying the integrated value for said any particular pixel to a corresponding electrode of a liquid crystal panel.

2. An apparatus for driving liquid crystal as set forth in claim 1 wherein said means for sampling and said integration means comprise:

a clock signal output circuit for producing a multiplicity of clock signals during the predetermined single time interval of said analog signal corresponding uniquely to said any particular pixel, a plurality of sample and hold circuits for holding the voltage values of the analog signal at times corresponding to said multiplicity of clock signals each time said multiplicity of clock signals is produced, an adder for adding the voltages held in said sample and hold circuits, and a divider for dividing the added voltages by the number of said multiplicity of clock signals.

3. A method for driving liquid crystal which comprises the steps of:

inputting an analog signal representing an image as a voltage waveform, each pixel of said image corresponding uniquely to a predetermined single time interval of said analog signal, integrating said input analog signal over the predetermined single time interval corresponding uniquely to any particular pixel to produce an integrated value for said any particular pixel, and applying said integrated value for said any particular pixel to a corresponding electrode of a liquid crystal panel.

4. A method for driving liquid crystal as set forth in claim 3 wherein said integrating said input analog signal for said any particular pixel is performed by:

producing a multiplicity of clock signals over said predetermined single time interval for said any particular pixel, holding the voltage values of said analog signal at times corresponding to said multiplicity of clock signals each time said multiplicity of clock signals is produced, adding the multiplicity of voltage values held, and dividing the added voltage values by the number of said multiplicity of clock signals.

5. An apparatus for driving liquid crystal which comprises:

an input means for inputting an analog signal representing an image as a voltage waveform, each pixel of said image corresponding to a predetermined unique single time interval of said analog signal, an integration means for integrating the analog signal over the predetermined unique single time interval corresponding to said each pixel to produce an integrated value for said each pixel, and an application means for applying the integrated value for said each pixel to a corresponding electrode of a liquid crystal panel.

* * * * *